US009844311B2

(12) United States Patent
Zhang

(10) Patent No.: US 9,844,311 B2
(45) Date of Patent: Dec. 19, 2017

(54) FLOOR WASHER CLEANING DEVICE AND FLOOR WASHER

(71) Applicant: SHENZHEN ZHIYI TECHNOLOGY CO., LTD., Shenzhen, Guangdong (CN)

(72) Inventor: Xuedong Zhang, Guangdong (CN)

(73) Assignee: SHENZHEN ZHIYI TECHNOLOGY CO., LTD., Shenzhen, Guangdong (CN)

( * ) Notice: Subject to any disclaimer, the term of this patent is extended or adjusted under 35 U.S.C. 154(b) by 0 days.

(21) Appl. No.: 15/107,718

(22) PCT Filed: May 23, 2016

(86) PCT No.: PCT/CN2016/083017

§ 371 (c)(1),
(2) Date: Jun. 23, 2016

(65) Prior Publication Data

US 2017/0332863 A1 Nov. 23, 2017

(51) Int. Cl.

| | |
|---|---|
| ***A47L 9/04*** | (2006.01) |
| ***A47L 5/00*** | (2006.01) |
| ***A47L 11/30*** | (2006.01) |
| ***A47L 11/40*** | (2006.01) |

(52) U.S. Cl.

CPC ..... *A47L 11/302* (2013.01); *A47L 11/4016* (2013.01); *A47L 11/4041* (2013.01); *A47L 11/4083* (2013.01); *A47L 11/4088* (2013.01)

(58) Field of Classification Search

CPC ..... A47L 11/302; A47L 11/4016; A47L 11/4041; A47L 11/4083; A47L 11/4088

See application file for complete search history.

(56) References Cited

U.S. PATENT DOCUMENTS

| | | | | |
|---|---|---|---|---|
| 2003/0204923 | A1* | 11/2003 | Nakamura | A46B 13/02 15/4 |
| 2005/0055785 | A1* | 3/2005 | Spooner | A47L 11/33 15/41.1 |
| 2008/0235897 | A1* | 10/2008 | Kim | A47L 7/02 15/319 |
| 2012/0096656 | A1* | 4/2012 | Jung | A47L 9/0411 15/52.1 |

* cited by examiner

*Primary Examiner* — Dung Van Nguyen
(74) *Attorney, Agent, or Firm* — Rankin, Hill & Clark LLP

(57) ABSTRACT

A floor washer cleaning device is mounted inside an opening cavity arranged at a bottom of a dustbin of the floor washer. The floor washer cleaning device comprises a roller brush assembly rotatably arranged inside the opening cavity, and a scraping board fixed at the bottom of the dustbin and located at an edge of a side of a bottom of the opening cavity. The scraping board, an inner wall of the opening cavity, and the roller brush assembly cooperatively enclose to form a negative pressure cavity communicating with the dustbin, and a suction nozzle communicating with the negative pressure cavity is formed between an inner side of the scraping board and the roller brush assembly.

11 Claims, 5 Drawing Sheets

FLOOR WASHER CLEANING DEVICE AND FLOOR WASHER

FIELD OF THE INVENTION

The present invention relates to the technical field of floor washers, and more particularly to a floor washer cleaning device and a floor washer.

BACKGROUND OF THE INVENTION

Environmental hygiene is an important factor affecting life quality; therefore, with continuous increase of requirements for life quality of the people, correspondingly, requirements for the environmental hygiene are higher and higher. However, in modern times, working pressure of the people increases day by day, and they urgently need to be freed from heavy cleaning work. Thus, many devices configured to clean floors appear so as to improve the environmental hygiene; the commonly used ones of these devices include cleaners, automatic mopping machines, sweeping machines, and floor washers.

A suction nozzle of a conventional floor washer is formed by a front rubber sheet and a rear rubber sheet, the two rubber sheet are respectively pasted on a rear of a cleaning device, and a gap between the front rubber sheet and the rear rubber sheet is small; the function of the front rubber sheet is to obstruct wind and increase a pressure of the suction nozzle, and an interference fit is formed between the rear rubber and a floor so as to centrally recycle garbage such as waste water, impurities, and so on. Since the gap between the front rubber sheet and the rear rubber sheet is small, as a result, garbage with a large volume is unable to enter the suction nozzle and thus is difficult to be cleaned; moreover, after being used for a long time, garbage is prone to pile at the suction nozzle and thus obstruct the suction nozzle, the cleaning quality is severely affected, and the user experience effect is debased. Furthermore, a roller brush in a cleaning device of this type of floor washer is usually a structure comprising a roller and a brush, which may result in that swept long hairs are very prone to be twined in the brush and are difficult to be cleaned.

SUMMARY OF THE INVENTION

A purpose of the present invention is to provide a floor washer clearing device and a floor washer, which are aimed at the problem in the prior art that a small gap of a suction nozzle of a conventional floor washer results in that garbage with a large volume is unable to enter the suction nozzle and thus is difficult to be cleaned.

An embodiment of the present invention provides a floor washer cleaning device, which is mounted inside an opening cavity arranged at a bottom of a dustbin of a floor washer; the floor washer cleaning device comprises a roller brush assembly rotatably arranged inside the opening cavity, and a scraping board fixed at the bottom of the dustbin and located at an edge of a side of a bottom of the opening cavity; the scraping board, an inner wall of the opening cavity, and the roller brush assembly cooperatively enclose to form a negative pressure cavity communicating with the dustbin, and a suction nozzle communicating with the negative pressure cavity is formed between an inner side of the scraping board and the roller brush assembly.

Furthermore, a top portion of the opening cavity defines a garbage entrance, and the garbage entrance communicates with the dustbin and the negative pressure cavity respectively.

Furthermore, the garbage entrance communicates with an air passage configured to allow garbage and waste water to enter the dustbin, and a top end of the air passage communicates with the dust bin.

Furthermore, the floor washer cleaning device further comprises a water spraying assembly arranged at the bottom of the dustbin and located at an edge of another side of the bottom of the opening cavity, and the water spraying assembly communicates with a clear water tank of the floor washer.

Furthermore, an aluminum strip is fixed at the bottom of the dustbin by screws and located at an edge of a side of the bottom of the opening cavity, and the scraping board is fixed on the aluminum strip.

Furthermore, the roller brush assembly includes a roller, a support transmission mechanism detachably connected with two ends of the roller, and a plurality of soft rubber brushes arranged at an outside wall of the roller surroundingly; the soft rubber brushers are distributed to extend along a length direction of the outside wall of the roller.

Furthermore, the plurality of soft rubber brushes are distributed uniformly and spacedly along a circumference of the outside wall of the roller on the outside wall of the roller.

Furthermore, the soft rubber brushes are distributed to bend and extend along the length direction of the outside wall of the roller, and a bending portion of each soft rubber brush forms a groove part.

Furthermore, the support transmission mechanism includes a transmission head and a support head that are arranged at two ends of the roller respectively, the support head is fixedly connected with a support base arranged at one end of the opening cavity, and the transmission head is transmittingly connected with a power assembly arranged at another end of the opening cavity.

Another embodiment of the present invention further provides a floor washer, which comprises a main body, and a clear water tank and a dustbin that are arranged inside the main body; a bottom of the dustbin has an opening cavity opening towards a floor; the floor washer further comprises the aforesaid floor washer cleaning device, and the floor washer cleaning device is arranged inside the opening cavity and faces the floor.

On the basis of the aforesaid technical solutions, in the floor washer cleaning device and the floor washer provided by the embodiments of the present invention, the scraping board is arranged at a side of the opening cavity of the dustbin, the scraping board, the inner wall of the opening cavity, and the roller brush assembly cooperatively enclose to form the negative pressure cavity communicating with the dustbin, and the suction nozzle communicating with the negative pressure cavity is formed between the inner side of the scraping board and the roller brush assembly, such that garbage with a large volume can enter the negative pressure cavity via the suction nozzle and further enter the dustbin. In this way, effective recycling of garbage with a large volume is realized, the recycling range is enlarged, and thus efficiency and quality of cleaning are improved.

DETAILED DESCRIPTION OF THE PREFERRED EMBODIMENT

In order to make the purposes, technical solutions, and advantages of the present invention be clearer, the present invention will be further described in detail hereafter with reference to the accompanying drawings and embodiments. It should be understood that the embodiments described herein are only intended to illustrate but not to limit the present invention.

It needs to be noted that if a component is described as "fixed at" or "arranged at" another component, it can be arranged at the another component directly or via an intermediate component existing simultaneously. If a component is described as "connected with" another component, it can be connected with the another component directly or via an intermediate component existing simultaneously.

Moreover, it needs to be further noted that the position terms used in the embodiments of the present invention, such as "left", "right", "top", "bottom", "front", "rear", and the like, are only mutually relative concepts or take a normal using state of a product as reference, and should not be regarded as having limitations. The implementation of the present invention will be described in detail hereinafter with reference to the embodiments.

Figure 1:
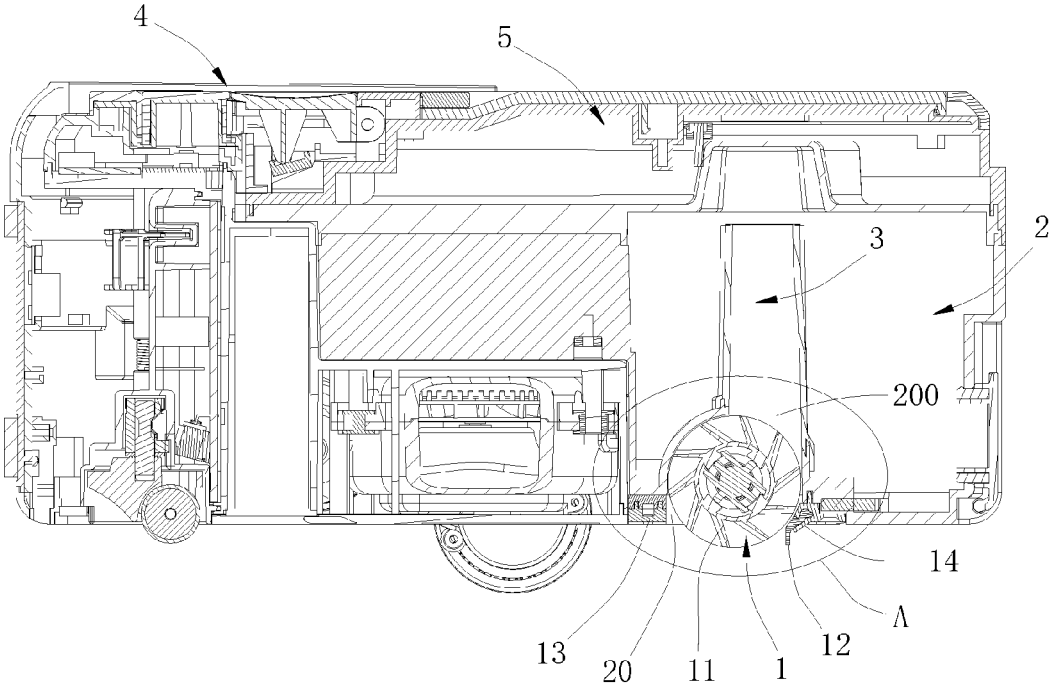
FIG. 1 is a cut-away schematic view of a floor washer provided by an embodiment of the present invention.
Figure 2:
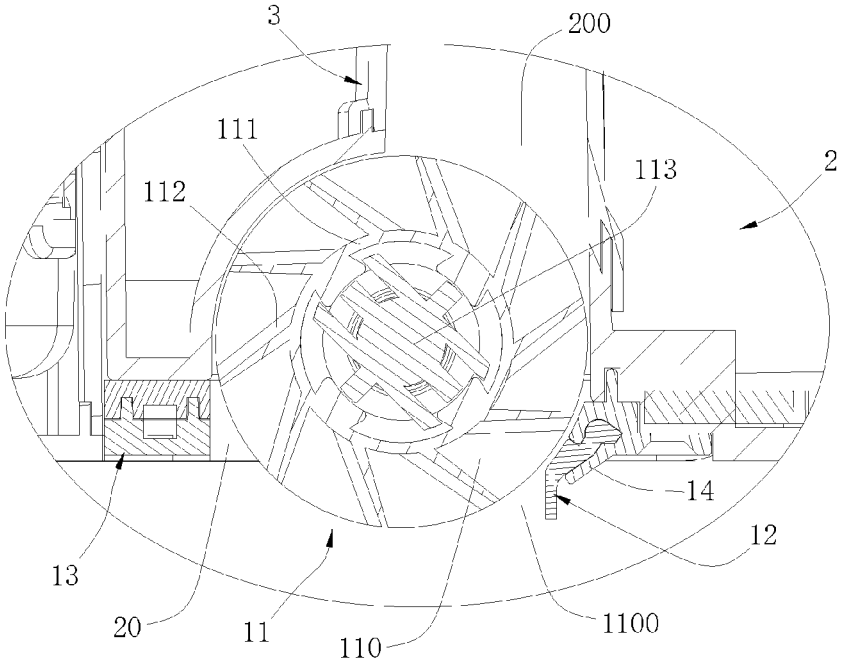
FIG. 2 is an enlarged schematic view of the part A shown in FIG. 1.
Figure 3:
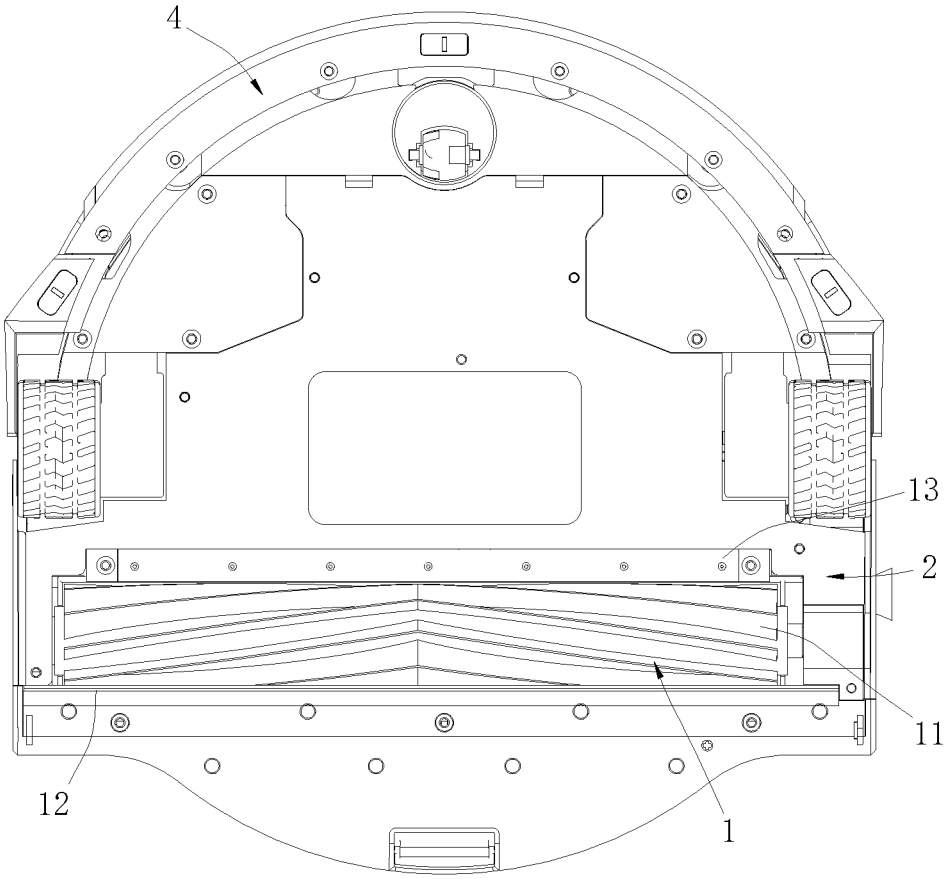
FIG. 3 is a bottom schematic view of a floor washer provided by an embodiment of the present invention.
Figure 4:
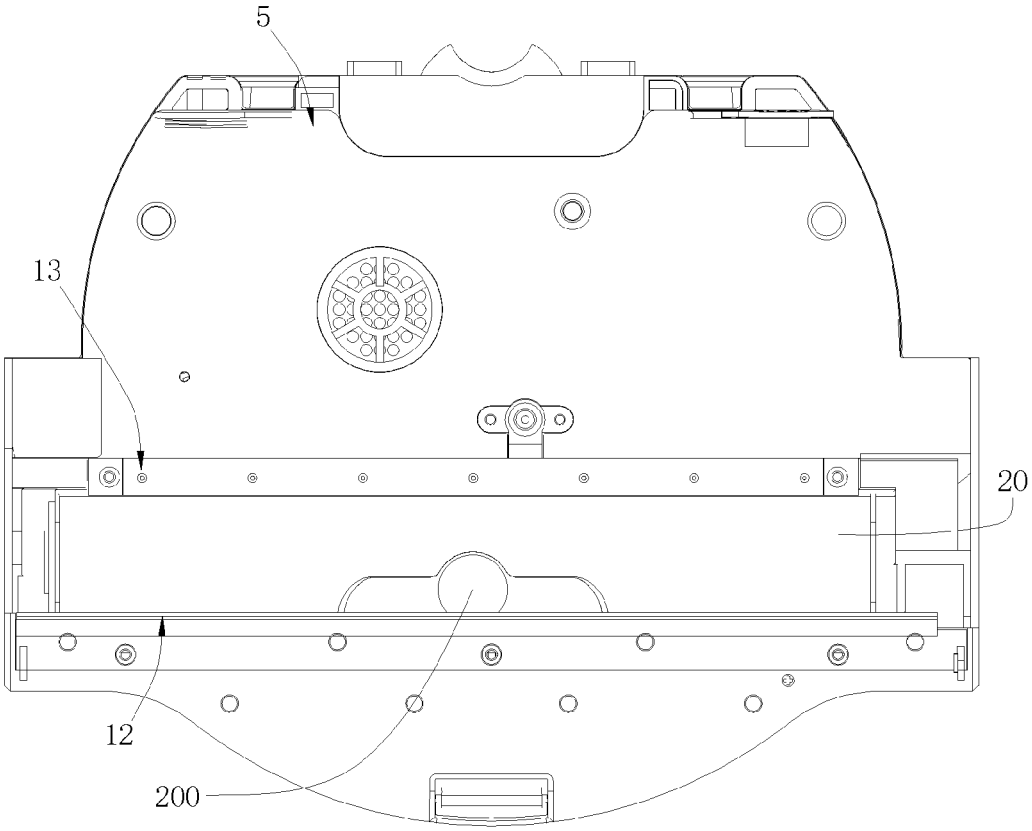
FIG. 4 is a bottom schematic view of an integrated structure comprising a dustbin and a clear water tank of an embodiment of the present invention.
Figure 5:
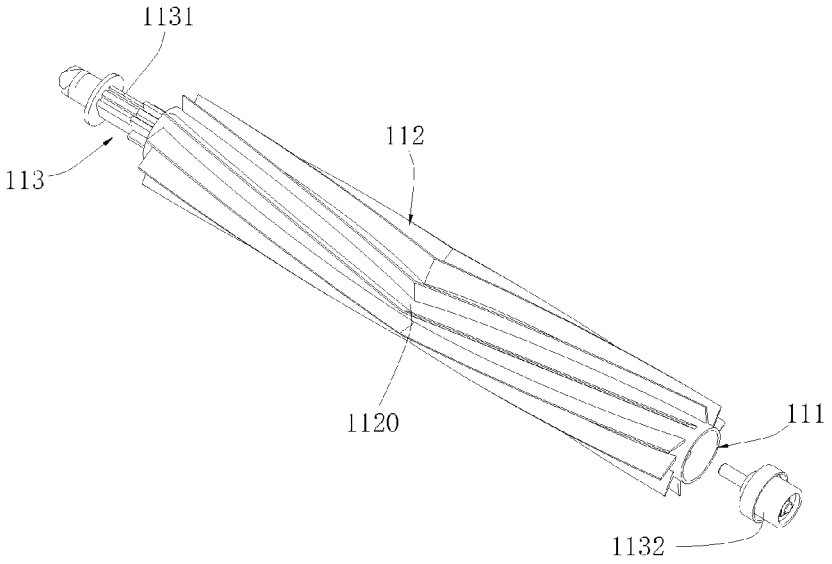
FIG. 5 is a disassembled schematic view of a roller brush assembly of an embodiment of the present invention.
Figure 6:
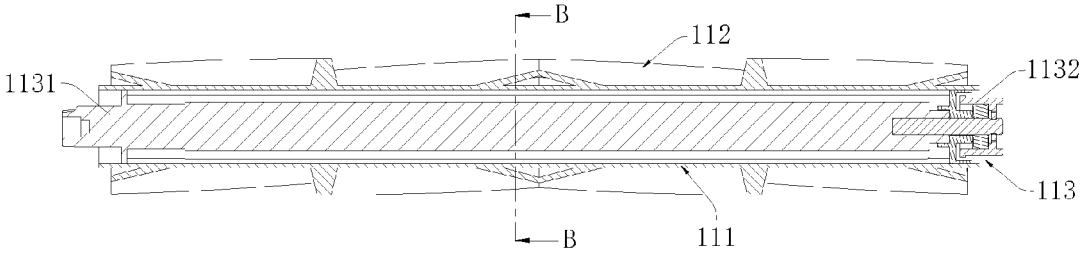
FIG. 6 is a cut-away schematic view of a roller brush assembly of an embodiment of the present invention.
Figure 7:
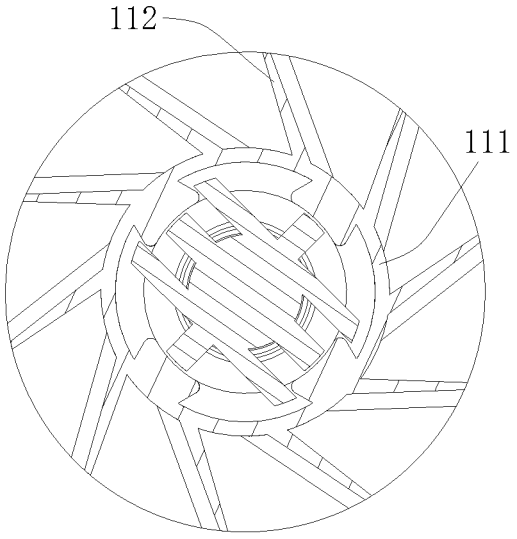
FIG. 7 is a cut-away schematic view along the B-B cutting direction shown in FIG. 6.

As shown in FIGS. 1-7, an embodiment of the present invention provides a floor washer cleaning device 1, and the floor washer cleaning device 1 is mounted inside an opening cavity 20 of a bottom of a dustbin 2 of a floor washer. In particular, the floor washer cleaning device 1 can comprise a roller brush assembly 11 and a scraping board 12, wherein, the roller brush assembly 11 is rotatably arranged in the opening cavity 20 of the bottom of the dustbin 2, the scraping board 12 is fixed at the bottom of the dustbin 2, and the scraping board 12 is located at a rear edge of the bottom of the opening cavity 20. Here, the scraping board 12, an inner wall of the opening cavity 20, and the roller brush assembly 11 cooperatively enclose to form a negative pressure cavity 110, and the negative pressure cavity 110 communicates with the dustbin 2; moreover, a suction nozzle 1100 is formed between an inner side of the scraping board 12 and the roller brush assembly 11, and the suction nozzle 1100 communicates with the negative pressure cavity 110. When the floor washer washes a floor, under the scraping function of the scraping board 12, waste water and garbage (including garbage with large volumes) on the floor can be suctioned into the negative pressure cavity 110 via the suction nozzle 1100, and are finally suctioned into the dustbin 2.

As detailed above, in the floor washer cleaning device 1 provided by the embodiment of the present invention, the scraping board 12 is arranged at a side of the opening cavity 20 of the dustbin 2, the scraping board 12, the inner wall of the opening cavity 20, and the roller brush assembly 11 cooperatively enclose to form the negative pressure cavity 110 communicating with the dustbin 2, and a suction nozzle 1100 communicating with the negative pressure cavity 110 is formed between the inner side of the scraping board 12 and the roller brush assembly 11; a size of the suction nozzle 1100 is larger than that of a conventional suction nozzle formed by two rubber sheets, in this way, garbage with a large volume and waste water can be suctioned into the negative pressure cavity 110 via the suction nozzle 1100 and further enter the dustbin 2. In this way, effective recycling of garbage with a large volume and waste water is realized, the recycling range is enlarged, and thus cleaning efficiency and cleaning quality are improved.

Furthermore, in an embodiment of the present invention, a top portion of the opening cavity 20 defines a garbage entrance 200, and the garbage entrance 200 communicates with the dustbin 2 and the negative pressure cavity 110 respectively. In particular, an air passage 3 is vertically arranged above the garbage entrance 200, a bottom end of the air passage 3 is aligned with the garbage entrance 200 and communicates with the garbage entrance 200, and a top end of the air passage 3 communicates with the dustbin 2. In this way, the negative pressure cavity 110, the air passage 3, and the dustbin 2 form an intercommunication. Here, the air passage 3 is configured to allow garbage and waste water to enter the dustbin 2. Of course, according to actual situations and specific requirements, in other embodiments of the present invention, the negative pressure cavity 110 can also communicate with the dustbin 2 by other methods, and the methods are not uniquely limited here.

Furthermore, in an embodiment of the present invention, the floor washer cleaning device 1 further comprises a water spraying assembly 13, the water spraying assembly 13 is arrange at the bottom of the dustbin 2, and the water spraying assembly 13 is located at an edge of a front side of the bottom of the opening cavity 20. Here, the water spraying assembly 13 communicates with the clear water tank 5 of the floor washer. Here, the water spraying assembly 13 is configured to spray washing water onto a floor to be washed. Of course, according to actual situations and specific requirements, in other embodiments of the present invention, the floor washer cleaning device 1 can further comprise other components.

Furthermore, in an embodiment of the present invention, an aluminum strip 14 is fixed at the bottom of the dustbin 2 by screws, the aluminum strip 14 located at an edge of a front side of the bottom of the opening cavity 20, and the scraping board 12 is sleeved in the aluminum strip 14. In production and machining, a water tank is formed by one-step injection molding firstly, then the scraping board 12 is fixed by the aluminum strip 14, and thus the aluminum strip 14 is fixedly assembled onto the dustbin 2 by screws. Of course, according to actual situations and specific requirements, in other embodiments of the present invention, the scraping board 12 can also be fixed at the bottom of the dustbin 2 by other methods, and the methods are not uniquely limited here.

Furthermore, in an embodiment of the present invention, a bottom part of the roller brush assembly 11 exposes from the bottom opening of the opening cavity 20 and contacts a floor to be washed. The roller brush assembly 11 can include a roller 111, a plurality of soft rubber brushes 112, and a support transmission mechanism 113, wherein, the roller 111 is rotatably arranged in the opening cavity 20, the plurality of soft rubber brushes 112 are arranged at an outside wall of the roller 111 surroundingly, and the brushers 112 are distributed to extend along a length direction of the outside wall of the roller 111 (or parallel to a central axis direction of the outside wall of the roller 111) on the outside wall of the roller 111. The support transmission mechanism 113 is detachably connected with two ends of the roller 111, and it is configured to support the roller 111 such that the roller 111 can rotate in the opening cavity 20. Here, the soft rubber brush 112 is preferably an elastic soft rubber sheet having certain rigidity. When the roller 111 rotates, the soft rubber brushes 112 arranged on the outside wall of the roller 111 surroundingly rotate along with the rotation of the roller 111; at the same time, the soft rubber brushes 112 continuously brush the floor, long hairs on the floor can be rolled up, some of the long hairs can be suctioned into the dustbin 2, additionally, some long hairs reach two sides of the soft rubber brush 112. In this way, when the floor washer stops working, the roller brush assembly 11 can be detached, and the hairs remaining thereon can be removed.

As described above, in this embodiment of the present invention, the aforesaid roller brush assembly 11 has the plurality of soft rubber brushes 112, which are arranged on the outside wall of the roller 111 surroundingly, have certain rigidity, and are shaped as elastic soft rubber sheet, and the soft rubber brushes 112 are distributed to extend along the length direction of the outside wall of the roller 111 on the outside wall of the roller 111. In this way, the roller 111 surrounded by the plurality of soft rubber brushes 112 is not prone to be twined with long hairs, and the rotation of the roller 11 can drive the long hairs to move towards the two ends of the roller 111, so that the long hairs can be removed by detaching the roller brush assembly 11. When sweeping a floor with long hairs, the long hairs on the floor are rolled up; some of the long hairs are suctioned into the dustbin 2, moreover, some of the long hairs reaches the soft rubber brushes 112; when the floor washer stops working, the roller brush assembly 11 can be detached and the hairs remaining thereon can be removed. Compared with cleaning of conventional brushes, the hairs on the roller brush assembly 11 of this embodiment are easier to be removed, in this way, the user experience effect is improved, and at the same time the structure of the roller brush assembly 11 is protected.

In an embodiment of the present invention, the plurality of soft rubber brushes 112 are distributed uniformly and spacedly along a circumference of the roller 111 on the outside wall of the roller 111. In this way, when the roller 111 rotates, the sweeping effect is more uniform, and thus the sweeping effect is improved. Of course, according to actual situations and specific requirements, in other embodiments of the present invention, the plurality of soft rubber brushes 112 can also be distributed on the outside wall of the roller 111 in other manners, and the manners are not uniquely limited here.

Furthermore, in an embodiment of the present invention, the brushes 112 are distributed to bend and extend along the length direction of the outside wall of the roller 111 on the outside wall of the roller 111. In particular, the soft rubber brushes 112 are distributed to bend and extend as V-shaped on the outside wall of the roller 111 and along the length direction of the outside wall of the roller 111 (or along a direction that is parallel to a central axis of the outside wall of the roller 111), and a bending portion of each soft rubber brush 112 forms a groove part 1120. The groove part 1120 is just the V-shaped bending portion. Here, the soft rubber brush 112 shaped as the elastic soft rubber sheet is provided with the groove part 1120 and can generate deformation, such that it is suitable for both large and small garbage. Of course, according to actual situations and specific requirements, in other embodiments of the present invention, the plurality of soft rubber brushes 112 can also be distributed on the outside wall of the roller 111 in other manners, and the manners are not uniquely limited here.

Furthermore, in an embodiment of the present invention, the support transmission mechanism 113 can include a transmission head 1131 and a support head 1132, and the transmission head 1131 and the support head 1132 are respectively arranged at two ends of the roller 111. In particular, the support head 1132 is arranged at one end of the roller 111 and is fixedly connected with a support base (not shown in the drawings) arranged at one end of the opening cavity 111, moreover, the transmission head 1131 is transmittingly connected with a power assembly (not shown in the drawings) arranged at another end of the opening cavity 20. In this way, the power assembly drives the transmission head 1131 to rotate, and the roller 111 synchronously rotates along with the transmission head 1131; at the same time, the support head 1132 at one end of the roller 111 supports the roller 111. Here, both the transmission head 1131 and the support head 1132 can be detached from the two ends of the roller 111, in this way, although some hairs twines on the two ends of the roller 111, as long as the transmission head 1131 and the support head 1132 are detached, the hairs can be removed, this is fast and convenient. Of course, according to actual situations and specific requirements, in other embodiments of the present invention, the roller brush assembly 11 can also include other components, and the components are not uniquely limited here.

As shown in FIGS. 1-7, and embodiment of the present invention provides a floor washer, the floor washer comprises a main body 4, and a clear water tank 5 and a dustbin 2 arranged inside the main body 4; a bottom of the dustbin 2 has an opening cavity 20 opening towards a floor; in this embodiment, the floor washer further comprises the aforesaid floor washer cleaning device 1, and the floor washer cleaning device 1 is arranged inside the opening cavity 20 and faces the floor.

In this embodiment of the present invention, washing water is sprayed onto the floor or the soft rubber brushes 112 via the water spraying assembly 13. When the floor washer moves forward, the soft rubber brushes 112 rotate along with the roller 111, such that garbage and waste water enter the dustbin 2 through the air passage 3 after passing through the suction nozzle 1100 and the negative pressure cavity 110, and the rest of the garbage and waste water is pushed forward by the scraping board 12; since an interference fit with a certain height is formed between the scraping board 12 and the floor, in this way, the purpose of recycling waste water and garbage by one-way ventilation can be achieved by the rotation of the soft rubber brushes 112. Since there is certain space between the soft rubber brushes 112 and the inner wall of the opening cavity 20, when the soft rubber brushes 112 rotate along with the roller 111, a vacuum cavity (i.e., the negative pressure cavity 110) is formed, such that a speed of an airflow increases, and the purposes of ventilation, drainage, and suctioning garbage are achieved. Moreover, whether the floor washer moves forward or backward, waste water and garbage will move from the soft rubber brushes 112 to the scraping board 12, and both of them can effectively enter the negative pressure cavity 110 through the gap (i.e., the suction nozzle 1100) between each soft rubber brush 112 and the scraping board 12; through the air passage 3, the waste water and the garbage are centrally recycled into the dustbin 2. As described above, the floor washer adopts the floor washer cleaning device 1, centralizes flows of wind, reduces loss of airflow, and centralizes garbage and recycles waste water in an opening manner, such that garbage with large volumes and waste water can be suctioned into the negative pressure cavity 110 via the suction nozzle 1100, and finally enter the dustbin 2; in this way, effective recycling of garbage with large volumes and waste water is realized, and the recycling range is enlarged; whether the floor washer moves forward or backward, it can work effectively and improve efficiency, such that the cleaning quality is improved.

The aforesaid embodiments are only preferred embodiments of the present invention, but the protection scope of the present invention are not limited by these embodiments. Any technician skilled in the art can easily conceive various equivalent modifications, replacements, and improvements within the technical range disclosed by present invention, and these modifications, replacements, and improvements should be all included in the protection scope of the present invention. Therefore, the protection scope of the present invention should take the protection scope of the claims as the standard.

What is claimed is:

1. A floor washer cleaning device, which is mounted in an opening cavity of a bottom of a dustbin of a floor washer; wherein, the floor washer cleaning device comprises a roller brush assembly rotatably arranged in the opening cavity, and a scraping board fixed at the bottom of the dustbin and located at an edge of a side of a bottom of the opening cavity; the scraping board, an inner wall of the opening cavity, and the roller brush assembly cooperatively enclose to form a negative pressure cavity communicating with the dustbin, and a suction nozzle communicating with the negative pressure cavity is formed between an inner side of the scraping board and the roller brush assembly, wherein, the floor washer cleaning device further comprises a water spraying assembly arranged at the bottom of the dustbin and located at an edge of another side of the bottom of the opening cavity, and the water spraying assembly communicates with a clear water tank of the floor washer.

2. The floor washer cleaning device according to claim 1, wherein, a top portion of the opening cavity defines a garbage entrance, and the garbage entrance communicates with the dustbin and the negative pressure cavity respectively.

3. The floor washer cleaning device according to claim 2, wherein, the garbage entrance communicates with an air passage configured to allow garbage and waste water to enter the dustbin, and a top end of the air passage communicates with the dust bin.

4. The floor washer cleaning device according to claim 1, wherein, an aluminum strip is fixed at the bottom of the dustbin by screws and located at an edge of a side of the bottom of the opening cavity, and the scraping board is fixed on the aluminum strip.

5. The floor washer cleaning device according to claim 1, wherein, the roller brush assembly includes a roller, a support transmission mechanism detachably connected with two ends of the roller, and a plurality of soft rubber brushes arranged at an outside wall of the roller surroundingly; the soft rubber brushers are distributed to extend along a length direction of the outside wall of the roller.

6. The floor washer cleaning device according to claim 5, wherein, the plurality of soft rubber brushes are distributed uniformly and spacedly along a circumference of the outside wall of the roller on the outside wall of the roller.

7. The floor washer cleaning device according to claim 6, wherein, the soft rubber brushes are distributed to bend and extend along the length direction of the outside wall of the roller, and a bending portion of each soft rubber brush forms a groove part.

8. The floor washer cleaning device according to claim 6, wherein, the support transmission mechanism includes a transmission head and a support head that are arranged at two ends of the roller respectively, the support head is fixedly connected with a support base arranged at one end of the opening cavity, and the transmission head is transmittingly connected with a power assembly arranged at another end of the opening cavity.

9. A floor washer, comprising a main body, and a clear water tank and a dustbin that are arranged inside the main body; a bottom of the dustbin having an opening cavity opening towards a floor; wherein, the floor washer further comprises a floor washer cleaning device according to claim 1, and the floor washer cleaning device is arranged inside the opening cavity and faces the floor.

10. A floor washer cleaning device, which is mounted in an opening cavity of a bottom of a dustbin of a floor washer; wherein, the floor washer cleaning device comprises a roller brush assembly rotatably arranged in the opening cavity, and a scraping board fixed at the bottom of the dustbin and located at an edge of a side of a bottom of the opening cavity; the scraping board, an inner wall of the opening cavity, and the roller brush assembly cooperatively enclose to form a negative pressure cavity communicating with the dustbin, and a suction nozzle communicating with the negative pressure cavity is formed between an inner side of the scraping board and the roller brush assembly, wherein, an aluminum strip is fixed at the bottom of the dustbin by screws and located at an edge of a side of the bottom of the opening cavity, and the scraping board is fixed on the aluminum strip.

11. A floor washer, comprising a main body, and a clear water tank and a dustbin that are arranged inside the main body; a bottom of the dustbin having an opening cavity opening towards a floor; wherein, the floor washer further comprises a floor washer cleaning device arranged inside the opening cavity and facing the floor, wherein the floor washer cleaning device, which is mounted in the opening cavity of the bottom of the dustbin of the floor washer comprises a roller brush assembly rotatably arranged in the opening cavity, and a scraping board fixed at the bottom of the dustbin and located at an edge of a side of a bottom of the opening cavity; the scraping board, an inner wall of the opening cavity, and the roller brush assembly cooperatively enclose to form a negative pressure cavity communicating with the dustbin, and a suction nozzle communicating with the negative pressure cavity is formed between an inner side of the scraping board and the roller brush assembly.

* * * * *